United States Patent [19]

Wise et al.

[11] 4,412,661

[45] Nov. 1, 1983

[54] SPOOL FABRICATED FROM CORRUGATED MATERIAL

[75] Inventors: Frederick M. Wise, Arvada; Carl F. DeWitt, Westminster, both of Colo.

[73] Assignee: Capitol Packaging Corporation, Denver, Colo.

[21] Appl. No.: 312,942

[22] Filed: Oct. 20, 1981

[51] Int. Cl.[3] ..... B65H 75/28

[52] U.S. Cl. ..... 242/77.4; 242/116; 242/118.32; 242/118.7

[58] Field of Search ..... 242/118.7, 115, 116, 242/118.6, 118.32, 77.3, 77.4

[56] References Cited

U.S. PATENT DOCUMENTS

| | | | |
|---|---|---|---|
| 671,446 | 4/1901 | Lorscheider | 242/118.7 |
| 2,001,569 | 5/1935 | Kiefer | 242/118.7 |
| 2,354,375 | 7/1944 | Howsam | 242/118.7 |
| 2,828,090 | 3/1958 | Steinback | 242/118.7 |
| 2,953,316 | 9/1960 | Henry | 242/118.7 |
| 3,266,749 | 8/1966 | Christian et al. | 242/118.7 |
| 4,066,224 | 1/1978 | Hargreaves | 242/118.7 X |

*Primary Examiner*—Stuart S. Levy
*Assistant Examiner*—Lloyd D. Doigan
*Attorney, Agent, or Firm*—Davis, Hoxie, Faithfull & Hapgood

[57] ABSTRACT

A spool comprising flanges fabricated from corrugated material connected by a central core and reinforced using metal plates. The flanges consist of at least two pieces of corrugated material fixed together in an orientation such that the corrugations angularly cross each other. For two pieces of corrugated material, a 90° angle of cross has been found particularly beneficial.

3 Claims, 5 Drawing Figures

SPOOL FABRICATED FROM CORRUGATED MATERIAL

FIELD OF THE INVENTION

The present invention relates to a spool fabricated from corrugated material upon which wire, rope or other pliable strand materials may suitably be wound.

DESCRIPTION OF THE PRIOR ART

Spools having round flanges connected by a central cylindrical core piece have been known for many years. Such spools normally have been made from wood. More recently attempts have been made to construct spools from other materials, including corrugated board. However, spools fabricated out of corrugated board have typically lacked the strength and durability required for many applications. Several winding and unwinding techniques suitable for use with wooden spools are unsuitable for use with an ordinary corrugated spool. For example, in one winding process the winding force is applied through a set screw which is screwed into an end flange of the spool. When this set screw winding process is used with corrugated end flanges, the screw tends to rip the corrugated material. In another winding process, the winding force is applied using clamps which clamp onto the two end flanges of the spool. A clamping force suitable for the high speed winding of a wooden spool may destroy a typical corrugated spool. In unwinding material from a spool, the spool is often placed on an arbor or spindle. If material is taken from the spool very rapidly, the spool will turn very rapidly. For typical corrugated spools, this rapid turning tends to break down the corrugated material around the hole through which the arbor or spindle fits. Once the breakdown of the corrugated material reaches a certain point, the spool is unsuitable for high speed unwinding. As a result of the problems outlined above as well as other similar problems, there has been a continuing demand for spools which are more easily fabricated, more economical, lighter and more durable than the spools which are currently known.

SUMMARY OF THE INVENTION

The present invention concerns a spool fabricated from corrugated material which meets the above demand for an economical, lightweight and durable spool. The invention comprises two flanges connected by a central core. Each flange consists of two pieces of doublewall corrugated material laminated together so that the corrugations of the two pieces are approximately at right angles to each other. The inner piece of corrugated material has a recess cut into it, and a central core fits into this recess. Two metal plates are used to add reinforcing strength to the corrugated flanges. These plates also provide a site for anchoring reinforcing rods which pass through the inside of the central core. The inner faces of the plates fit snugly against the outer faces of the flanges. The reinforcing rods are equally spaced around the inside wall of the central core and pass through both flanges and plates. Lock caps fit on the ends of the reinforcing rods and butt up against the outer face of the plates thus holding the reinforcing rods in place.

DESCRIPTION OF PREFERRED EMBODIMENT

Figure 1:
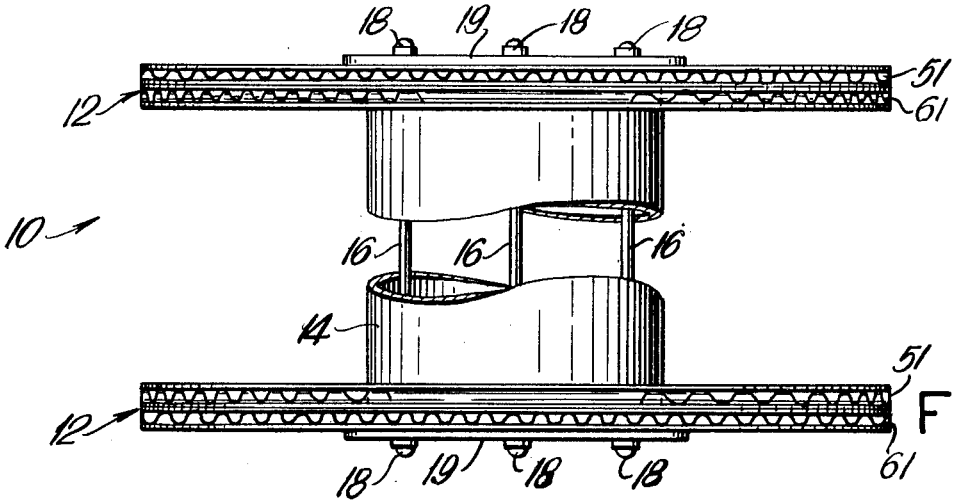
FIG. 1 is an elevation view, partly cut away, of a spool according to one embodiment of the invention.

FIG. 1 illustrates an embodiment of the invention. FIG. 1 shows a spool 10 having two flanges 12 connected by a central core 14, internal reinforcing rods 16, lock caps 18 and reinforcing plates 19. In this embodiment, each flange 12 is constructed of two circular layers of corrugated material 51 and 61 which are glued or otherwise laminated together with their lines of corrugation crossing approximately at right angles. Plates 19, held firmly against the outer surface of each flange by the pressure of lock caps 18, provide reinforcement for the flanges 12.

Figure 2:
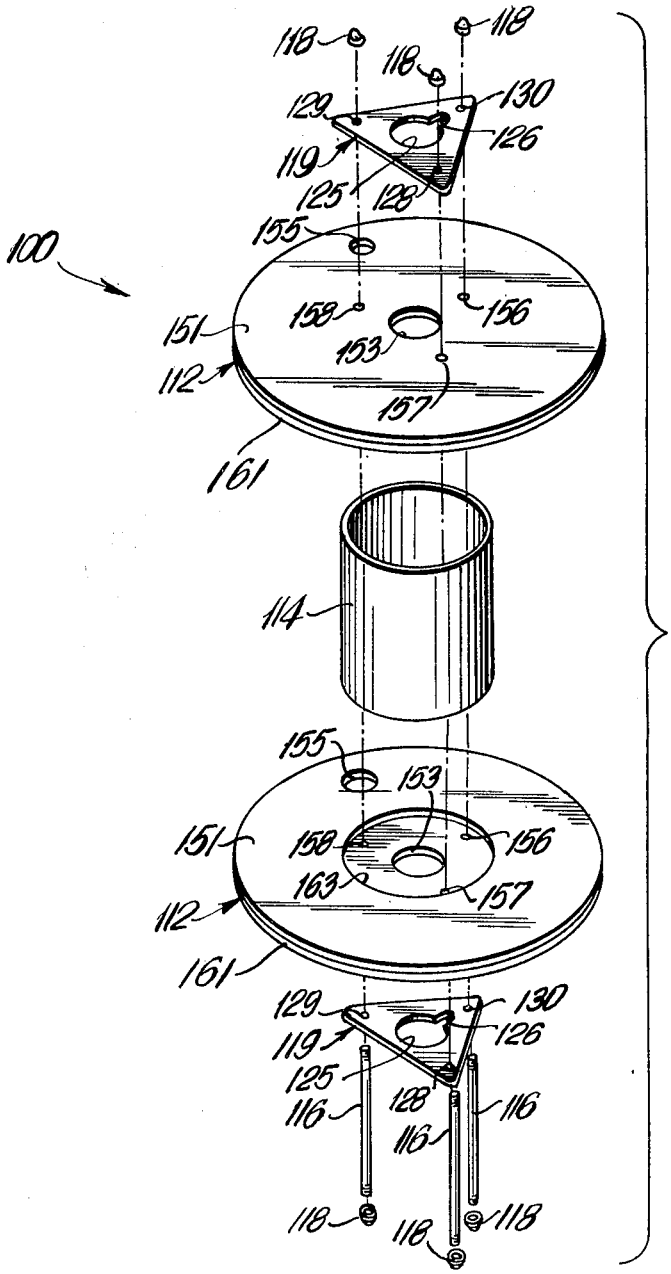
FIG. 2 is an exploded view which illustrates the construction of apparatus according to a second and preferred embodiment of the invention.
Figure 3:
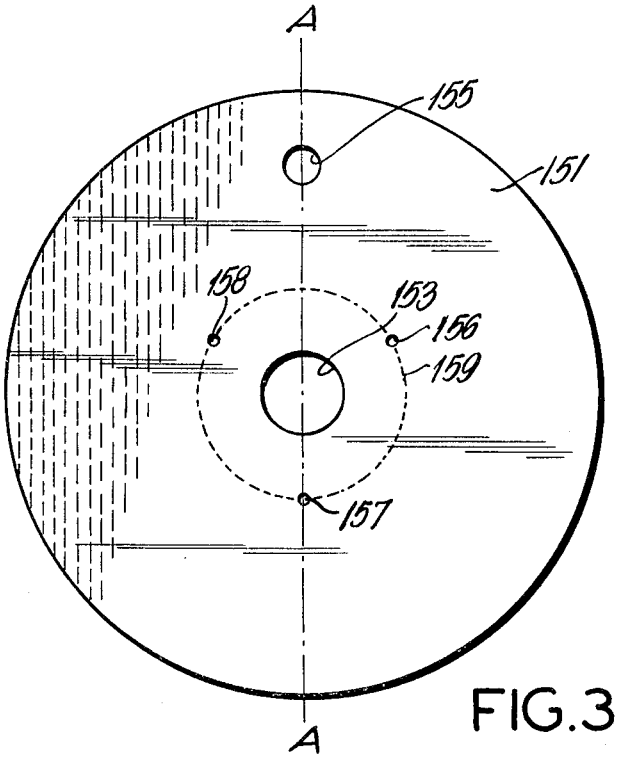
FIG. 3 illustrates one component of a flange suitable for use in the second embodiment of the invention.

A complete spool 100 incorporating the features of the preferred embodiment is shown in FIG. 2 in an exploded view. Spool 100 has flanges 112 each comprised of layers 151 and 161; a central fiber core 114; three reinforcing rods 116; two metal reinforcing plates 119 and six lock caps 118. Each flange 112 of the spool 100 is constructed of two layers of corrugated material 151 and 161 which are laminated together. The laminated construction of each flange 112 will be discussed in the context of FIGS. 3 and 4 which show in detail layers of corrugated material 151 and 161. The line of corrugations in both FIGS. 3 and 4 is parallel to the line A—A.

In the preferred embodiment, the layers 151 and 161 each consist of a 16 inch diameter circular layer of 275 pound double wall corrugated fiber board. One layer 151 is shown in FIG. 3. Layer 151 has a $2\frac{1}{4}$ inch diameter opening 153 at its center and a 1 inch diameter opening 155 approximately two inches radially inward from its perimeter. The center of opening 155 lies on the line A—A, the line of corrugation passing through the center of layer 151. Three 7/32 inch diameter openings 156, 157 and 158 are also cut through layer 151. These openings 156, 157 and 158 have their centers 2 13/16 inches from the center of layer 151. The center of the openings 156, 157 and 158 are equally spaced on the circumference of a circle 159 shown in FIG. 3 as a dotted line. Opening 157, like opening 155, has its center on the line of corrugations which passes through the center of layer 151; however, opening 157 is located 180° from opening 155.

Figure 4:
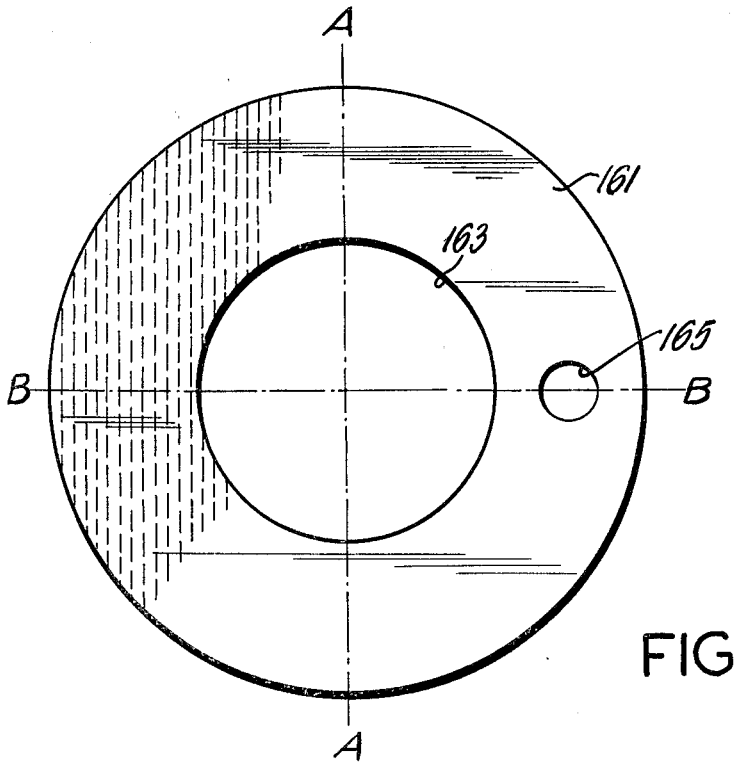
FIG. 4 illustrates a second component of the flange suitable for use in the second embodiment of the invention.

The second layer 161 is shown in FIG. 4. Layer 161 has at its center an opening 163 which has a diameter of $6\frac{1}{4}$ inches. It has a second opening 165 with a $1\frac{3}{8}$ inch diameter located 6 inches from its center and on line B—B which is perpendicular to the line A—A. I.e., line B—B is perpendicular to the corrugation direction.

Each of the flanges 112 is constructed by laminating together a layer 151 and a layer 161. Layers 151 and 161 are oriented prior to lamination so that openings 155 and 165 are aligned. This alignment insures that the corrugations of the layers 151 and 161 will be perpendicular or nearly perpendicular and that consequently a strong flange, resistant to bending in any direction, will result. When layers 151 and 161 are laminated together, the opening 163 in the inner layer 161 forms a recess into which the central core 114 fits.

Figure 5:
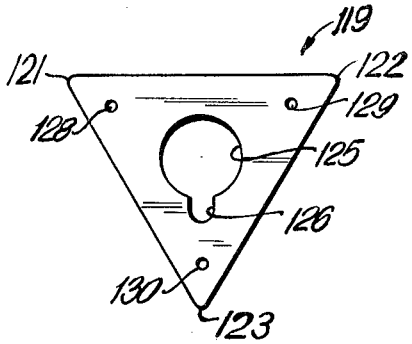
FIG. 5 illustrates a triangular metal plate suitable for use in a second and preferred embodiment of the invention.

Reinforcing plates 119 suitable for use in the preferred embodiment of the invention are illustrated in greater detail in FIG. 5. In the preferred embodiment reinforcing plates 119 are triangular and are made of metal. A suitable reinforcing plate 119 may be formed starting with a triangle of metal, rounding the corners 121, 122, 123; punching or cutting in the center an opening 125 having a slot 126 therein and forming smaller openings 128, 129, 130 near the three corners of the triangle. The central opening 125 receives an arbor or a spindle inserted during the winding or unwinding of material onto or from the spool. The openings 128, 129 and 130 are for reinforcing rods to pass through.

The purpose of plates 119 will now be explained. The metal reinforcing plates 119 tend to impede the deterioration of the corrugated material around the openings 153 particularly during the high speed unwinding of the spool on an arbor and facilitate removal of the spool from the arbor once winding or unwinding is completed. During winding using end clamps, there may be a large side pressure applied to the spool when the clamping members clamp onto the sides of the spool. Any slippage during winding may result in significant wear to spools having flanges of wood or corrugated material alone. Reinforcing plates 119 decrease this wear. The slot 126 may be used to prevent damage to the spool during winding when a winding force is applied using a set screw which is screwed into an end flange. When winding force is applied, the set screw will tear the corrugated material of the flange only until it butts up against the metal edge of slot 126. Slot 126 prevents significant damage to the flange and the spool while allowing use of the set screw winding process.

A reinforcing plate 119 with certain dimensions has been found particularly suitable for use with the spool 100 shown in FIG. 2. While it is clear that other spool sizes may be constructed without departing from the invention, the preferred embodiment will be discussed in the context of a 16 inch spool. The metal plate 119 for use with a 16 inch spool consists of an equilateral triangle with sides which are approximately 7 inches long. The rounds of the corners 121, 122 and 123 have a radius of $\frac{1}{4}$ inch. The central opening 125 has a radius of $1\frac{1}{8}$ inch. The slot 126 has as its central axis a line drawn through the center of opening 125 and bisecting a side of the triangle. The slot 126 is cut outwardly from the opening 125 towards a corner of the triangle and has an overall length of $\frac{5}{8}$ inch including a rounded end with a radius of 5/16 inch. The openings 128, 129 and 130 have a diameter of 7/32 inch. These openings 128, 129 and 130 have their centers at a point 2 3/16 inches from the center of the triangle and on a line which passes through the center of the triangle and bisects the side of the triangle opposite the corner in which the respective opening is cut.

From FIG. 2, it is seen that the openings 153, 155, 156, 157 and 158 in the layers 151 are aligned by properly aligning the flanges 112. Each metal plate 119 is aligned with its openings 128, 129 and 130 in line with the opposite corresponding openings on the other plate. Reinforcing rods 116 which have a cross sectional diameter of 3/16 inch are inserted through the plates 119 and the flanges 112. Lock caps 118 are tightened onto each end of the rods 116 to lock them in place. The reinforcing rods 116 lie inside and adjacent to the inner wall of the core 114.

While the spool 100 has been particularly described with regard to dimension and material, it is contemplated that other sizes of spools may be constructed according to the invention and that other weights of corrugated board and other types of corrugated materials such as plastic might be used for the flanges 112. Further, more than two layers of corrugated material could be used, with corrugations in each two adjacent layers being nearly at right angles. The plates 119, while described as being triangular with rounded corners and as being made of metal, might be made in other shapes of other suitable material. While three reinforcing rods 116 have been shown, a larger number could also suitably be used.

We claim:

1. A spool suitable for receiving wound pliable strands comprising:

a hollow circular cylindrical core;

two flanges, each flange being composed of at least two layers of circular corrugated material, one layer of which constitutes an innermost layer and another of which constitutes an outermost layer, the corrugations in each layer of corrugated material being arranged at an angle of about 90° with the corrugations in any adjacent layer, the innermost layer in each flange having a circular central opening in which one end of the core is received;

a plurality of reinforcing rods which pass inside the core and extend through the flanges; and two reinforcing plates of a material more resistant to tearing than the material of the flanges, each of which is substantially smaller in area than each of the two flanges, one plate being held firmly against the outermost layer of each flange by connection to the plurality of reinforcing rods whereby a lightweight and durable spool suitable for use with conventional winding devices is formed wherein each of the reinforcing plates has a central opening therethrough and at least one of the reinforcing plates has a slot extending radially outward from its central opening, the slot being included to allow a set screw of a winding device to be screwed into the flange and to prevent excessive tearing of the flange when winding force is applied.

2. A spool suitable for receiving wound pliable strands comprising:

a hollow circular cylindrical core;

two flanges, each flange being composed of two circular layers of corrugated material, one layer of which constitutes an innermost layer and another layer of which consitutes an outermost layer, each layer comprising a circular piece of fiber board having at least two parallel corrugations laminated together, the two layers laminated together so that their corrugations are substantially perpendicular to one another, the innermost layer in each flange having a circular central opening in which one end of the core is received;

three reinforcing rods spaced apart an equal distance which pass inside the core and extend through the flanges;

six locking caps; and two triangular metal reinforcing plates each having three holes through which the reinforcing rods pass, each reinforcing plate being substantially smaller in area than each of the two flanges, one reinforcing plate being held firmly against the outermost layer of each flange by forcing a locking cap onto the end of each reinforcing rod until it butts up against the properly positioned flange.

3. The spool of claim 2 wherein each of the reinforcing plates has a central opening therethrough and at least one of the reinforcing plates has a slot extending radially outward from its central opening, the slot being included to allow a set screw of a winding device to be screwed into the flange and to prevent excessive tearing of the flange when winding force is applied.

* * * * *